US005837665A

United States Patent [19]

Young

[11] Patent Number: 5,837,665

[45] Date of Patent: Nov. 17, 1998

[54] SPOT CLEANER FOR CARPETS

[76] Inventor: Robert Young, 8601 Roland St., Suite A, Buena Park, Calif. 90621

[21] Appl. No.: 871,459

[22] Filed: Jun. 9, 1997

Related U.S. Application Data

[63] Continuation-in-part of Ser. No. 644,665, May 2, 1996, abandoned.

[51] Int. Cl.[6] ..... C11D 3/06; C11D 3/20; B08B 3/00

[52] U.S. Cl. ..... 510/278; 510/280; 510/281; 510/342; 510/359; 510/426; 510/432; 510/495; 510/506; 8/137

[58] Field of Search ..... 510/278, 280, 510/281, 342, 359, 426, 432, 495, 506; 8/137

[56] References Cited

U.S. PATENT DOCUMENTS

| | | | |
|---|---|---|---|
| 4,152,306 | 5/1979 | DeMatteo, Jr. | 510/182 |
| 4,175,062 | 11/1979 | Disch et al. | 510/424 |
| 4,576,738 | 3/1986 | Colodney et al. | 510/424 |
| 4,725,319 | 2/1988 | Osberghaus | 134/4 |
| 4,803,008 | 2/1989 | Ciolino et al. | 510/419 |
| 4,826,618 | 5/1989 | Borseth et al. | 510/417 |
| 4,880,558 | 11/1989 | Jost et al. | 510/421 |
| 4,895,675 | 1/1990 | Smith | 510/104 |
| 4,931,102 | 6/1990 | Burke | 134/2 |
| 4,983,317 | 1/1991 | Requejo et al. | 510/419 |
| 5,102,573 | 4/1992 | Han et al. | 510/197 |
| 5,376,297 | 12/1994 | Choy et al. | 510/418 |
| 5,429,684 | 7/1995 | Osberghaus et al. | 134/3 |
| 5,580,495 | 12/1996 | Young | 510/340 |
| 5,712,240 | 1/1998 | Tyerech et al. | 510/424 |
| 5,728,669 | 3/1998 | Tyerech | 510/280 |

FOREIGN PATENT DOCUMENTS

| | | |
|---|---|---|
| 0286075 | 10/1988 | European Pat. Off. . |

*Primary Examiner*—Paul Lieberman
*Assistant Examiner*—Lorna M. Douyon
*Attorney, Agent, or Firm*—Stuart W. Knight

[57] ABSTRACT

An effective carpet spot cleaner is provided which is comprised of sodium polyphosphate and/or sodium tripolyphosphate; sodium dodecylbenzenesulfonate and Butyl Cellosolve.

4 Claims, No Drawings

SPOT CLEANER FOR CARPETS

This application is a continuation-in-part of my application Ser. No. 08/644,665 filed May 2, 1996 now abandoned.

BACKGROUND OF THE INVENTION

This Invention relates to a spot cleaner to clean difficult areas of carpets.

The art has developed numerous compositions for cleaning of carpets. Generally, an aqueous solution is utilized which comprises various solvents, color, odor and other additives. The key to development of an effective cleaner or shampoo has been and continues to be the search for an effective combination of various detergents.

The carpet industry has developed sophisticated synthetic fibers which are longer lasting that those manufactured in previous years. Thus, there is a need for development of more effective carpet cleaners. Furthermore, economics dictate the type of cleaning composition. For example, if one desires a highly effective cleaner, then a more concentrated, and thus more expensive composition is desired.

One of the factors which must be considered in utilizing a more highly effective cleaner is the deleterious effect that chemicals have on carpets. Obviously some chemicals, while being effective cleaners, can simply cause breakdown of the fibers and thus harm the carpet. Accordingly, highly reactive materials must be excluded from the cleaning composition. Thus there is a delicate balance between providing an effective cleaner while providing a cleaner which will not harm the carpet.

Accordingly, there is a need for a development of a composition to "spot clean" difficult areas of a carpet so that the user need not purchase such more expensive cleaner to service the entire carpet. Additionally, the use of a more concentrated cleaner may have has a deleterious effect on the carpet. Thus, a spot cleaner is only utilized in difficult areas of the carpet.

Further, the spot cleaner must exclude those chemicals which are expensive or may be harmful to the carpet.

Accordingly, there is a great need in the art for development of more effective "spot cleaners".

Accordingly, one object of the Invention is to provide a cleaner which will effectively remove dirt, stains and the like from various fabrics. Another object of the Invention is to provide a more effective "spot cleaner" which can be applied to areas of greater degree of dirt, stain and the like. Other objects of the Invention will be apparent from the following discussion.

DISCLOSURE OF THE INVENTION

The Invention herein comprises a "spot cleaner" for use in carpet areas which have dirt and stains which generally are difficult to remove and in some cases cannot be removed utilizing normal shampoos.

The Invention herein comprises a unique combination of ingredients contained in an aqueous solution. The unique combination of ingredients comprises an alkali metal pyrophosphate or tripolypyrophosphate, or a combination thereof; an alkali metal; an alkylaryl sulfonate; and a mono-alkyl ether of ethylene glycol.

The alkali metal pyrophosphate or tripolypyrophosphate is preferably a sodium poly phosphate or sodium tripolyphosphate. The alkylaryl sulfonate is preferably sodium dodecylbenzenesulfonate. The mono-alkyl ether of ethylene glycol is preferably butyl ether which is sold under the trade name "Butyl Cellosolve".

Accordingly, the preferred unique composition is one containing sodium polyphosphate; sodium dodecylbenzenesulfonate; and Butyl Cellosolve.

The alkali metal polyphosphate and/or tripolyphosphate is generally 3 to 8 percent by weight of the entire diluted solution; the alkylaryl sulfonate is generally one to four percent by weight of the entire solution; and the Butyl Cellosolve is generally eight to twenty percent by weight of the entire diluted solution.

The remaining balance of the solution are various added solvents, such as an isopropanol, a fragrance enhancer, such as the material marketed under the trade name "Limonene", and other known additives. The principal solvent is water. The isopropanol is added in an amount less than 2 percent, and the Limonene and other ingredients are only added in trace amounts. Thus, the amount of water is some amount over 70 percent by weight of the entire diluted solution.

A most preferred solution is that comprising a sodium polyphosphate and/or sodium tripolyphosphate in an amount of 5 percent; a sodium dodecylbenzenesulfonate in an amount of 2.5 percent; Butyl Cellosolve in an amount of 15 percent; isopropanol solvent in the amount of 1 percent and a trace amount of Limonene in the amount of 0.03 percent. The sodium polyphosphate/sodium tripolyphosphate ratio is generally 90:10, preferably 70:30. Either phosphate is suitable alone, but preferably in combination.

It has been found that the above combination of ingredients results in an extremely highly effective cleaner. Thus, the above composition can be utilized as a "spot cleaner" for difficult areas of carpeting.

For clarification, below is a sample of a preferred and typical composition.

| Component | Concentration (% by weight) | Range (% by weight |
|---|---|---|
| Sodium Pyrophosphate/ Sodium Tripolyphosphate | 4.9 | 3–8 |
| Sodium dodecylbenzenesulfonate | 2.4 | 1–4 |
| Butyl Cellosolve | 15 | 8–20 |
| Isopropanol | 0.9 | 0.2–2.0 |
| Limonene | 0.03 | trace 0.1 |
| Water | Balance | Balance |

The above solution excludes those reactive materials which may harm carpets and further, the above solution excludes expensive chemicals. For example, the various amines are excluded.

The above solution has been found to be suitable and to include only relatively inexpensive and readily available materials. Thus, other reactive chemicals are excluded. Thus the ethanol amines are excluded from the spot-cleaning solution. Such amines are not required for effective spot cleaning of carpets.

Accordingly, the above combination of ingredients has been found to result in a highly effective "spot cleaner" for carpets without having any substantial deleterious effect on the carpet and includes available and relatively inexpensive materials.

I claim:

1. An aqueous liquid detergent composition used for the cleaning of fabrics, consisting of three to eight percent by weight of an alkali metal polyphosphate, or tripolyphosphate; one to four percent by weight of an alkali metal alkylaryl sulfonate; and eight to twenty percent by weight of a mono-alkyl ether of ethylene glycol; said weight percentages being of a total aqueous composition.

2. The aqueous liquid detergent composition of claim 1 wherein the polyphosphate or tripolyphosphate is sodium polyphosphate; the sulfonate is sodium dodecylbenzene-sulfonate; and wherein the mono-alkyl ether of ethylene glycol is ethylene glycol monobutyl ether.

3. A process of cleaning a carpet comprising contacting said carpet with an aqueous liquid detergent composition consisting essentially of three to eight percent by weight of an alkali metal polyphosphate, or tripolyphosphate; one to four percent by weight of an alkali metal alkylaryl sulfonate; and eight to twenty percent by weight of a mono-alkyl ether of ethylene glycol; said weight percentages being of a total aqueous composition.

4. A process as in claim 3 wherein said aqueous liquid detergent composition excludes any amine.

* * * * *